US005720461A

United States Patent [19]

Kerr, Jr.

[11] Patent Number: 5,720,461

[45] Date of Patent: Feb. 24, 1998

[54] HANGER SUPPORT UNIT FOR CEILING FANS

[75] Inventor: Jack R. Kerr, Jr., College Station, Tex.

[73] Assignee: Fan Tex, Inc., College Station, Tex.

[21] Appl. No.: 496,736

[22] Filed: Jun. 29, 1995

[51] Int. Cl.[6] ..... A47H 1/10

[52] U.S. Cl. ..... 248/317; 248/217.3; 248/546; 248/906

[58] Field of Search ..... 248/317, 546, 248/544, 644, 200.1, 216.1, 217.2, 323, 354.4, 354.6, 906; 211/105.3, 105.4

[56] References Cited

U.S. PATENT DOCUMENTS

| | | | |
|---|---|---|---|
| 2,713,983 | 7/1955 | Kay | 248/906 |
| 2,917,263 | 12/1959 | Appleton et al. | 248/217.3 |
| 3,518,421 | 6/1970 | Cogdill . | |
| 4,405,111 | 9/1983 | Lennon | 248/544 |
| 4,463,923 | 8/1984 | Reiker | 248/906 |
| 4,518,141 | 5/1985 | Parkin | 248/906 |
| 4,659,051 | 4/1987 | Propp et al. | 248/546 |
| 4,682,452 | 7/1987 | Propp et al. | 52/118 |
| 4,909,405 | 3/1990 | Kerr, Jr. | 220/3.9 |
| 5,096,330 | 3/1992 | Artzberger | 404/97 |
| 5,150,868 | 9/1992 | Kaden | 248/343 |
| 5,303,894 | 4/1994 | Deschamps et al. | 248/343 |

FOREIGN PATENT DOCUMENTS

| | | | |
|---|---|---|---|
| 240296 | 10/1987 | European Pat. Off. | 411/412 |

*Primary Examiner*—Ramon O. Ramirez
*Assistant Examiner*—Anita M. King
*Attorney, Agent, or Firm*—Daniel Rubin

[57] ABSTRACT

An improved hanger assembly for the support of heavy hanging loads at the underside of a ceiling. The assembly is longitudinally expandable via a threaded rod secured between relatively displaceable longitudinal bars in which the rod includes an allthread having a double to triple lead for increasing the expansion rate while teeth at the distal end of each bar are configured to arcuately displace inward of the joists in the course of joist penetration to effect a grasping penetration therewith.

9 Claims, 1 Drawing Sheet

HANGER SUPPORT UNIT FOR CEILING FANS

FIELD OF THE INVENTION

The field of art to which the invention pertains comprises the art of support structures by which to hang relatively heavy units such as ceiling fans, light fixtures, etc. from a selected ceiling location.

BACKGROUND OF THE INVENTION

In new building construction or in existing building construction where wood joist or studs are completely exposed and relatively accessible, providing additional structural support at the mounting site of a ceiling fan or relatively heavy light fixture can be readily effected by well known forms of brackets, bracing, etc. However, for ceiling mounting of a ceiling fan, relatively heavy light fixture, potted plants, etc. in existing building structures without ready access to the studs or joists, installation becomes considerably more difficult if removal of the wall or ceiling board is to be avoided.

Where the ceiling is between floors of a multi-story structure, installation can prove particularly troublesome. It has become common in order to achieve adequate support in these situations, to utilize a commercially available form of interjoist hanger assembly. The assembly is typically secured transversely between the studs/joists above a four inch box opening at the mounting site. Typically utilized in combination with the hanger assembly dependently supported at the opening is a modified electrical outlet box selected to accommodate the particular load value sought to be supported.

BACKGROUND OF THE PRIOR ART

Various devices have been proposed for interjoist hanger support that can be installed through a four inch opening normally provided in a ceiling for an electrical outlet box. Exemplifying such devices are the disclosures of U.S. Pat. Nos. 2,140,861; 3,518,421; 4,405,111; and 4,463,923. Installation of these units generally require two workman along with complete access to the work area. A form of hanger assembly capable of installation by a single workman is disclosed in my prior U.S. Pat. No. 4,909,405 incorporated herein by reference.

Another and particularly effective prior art hanger assembly for these purposes is the hanger structure disclosed in U.S. Pat. No. 4,659,051 of which I am a co-inventor. The '051 patent is likewise incorporated herein by reference and discloses a hanger assembly utilizing a threaded expansion bolt in cooperation with a tubular sleeve for expanding the hanger unit transversely between adjacent wood joists. The assembly includes rotatably supported opposite end screws theadedly matched to the bolt threads and each surrounded by a floating swivel having axially directed prongs or teeth. When the bolt is unextended, the unit can be readily inserted through the four inch box opening in the wall board. When fully extended, the end screws and surrounding teeth can be caused to engage and secure the hanger assembly to the opposite joists or studs thereat.

A principal underlying objective in the installation of such hangers is to insure that the hanging load be sustained to the maxinum extent possible by the joists or studs to which the hanger is initially secured. For obvious reasons, it is highly desirous that an underlying ceiling of sheet rock not even share the loading and is to be avoided. Unfortunately, a characteristic of the wood joist is the tendency to bow outward in the course of installing the hanger followed in about 4–6 weeks by a tendency to relax. The adverse effect of relaxation with said prior hangers has been to permit partial withdrawal of the hanger teeth with a consequent partial transfer of the hanging load from the joists onto the ceiling below.

Despite recognition of the foregoing, an improved and superior hanger assembly structure able to preclude the foregoing transfer of load has not heretofore been known.

OBJECTS OF THE INVENTION

It is an object of the invention to provide a novel hanger assembly for the support of hanging loads that is effective in the course of installation to resist a potential load transfer effect from subsequent joist relaxation.

It is a further object of the invention to effect the previous object with a hanger expansion structure having teeth that remain embedded in the joists in a grasping relation so as to follow the joists in the course of subsequent relaxation.

It is a still further object of the invention to effect the previous objects with a hanger structure characterized by accelerated expansion in the course of installation along with gripper teeth operative to arcuately penetrate the joist wood and effect a grasping penetration therewith.

SUMMARY OF THE INVENTION

This invention relates to a novel hanger assembly for supporting a relatively heavy hanging load from the underside of a ceiling. More specifically, the invention hereof relates to such a hanger assembly which when installed, substantially if not completely, eliminates the previous adverse load transfer effects associated with subsequent relaxation of the connected joists.

The foregoing is achieved in accordance with the invention by means of a displaceable two section hanger assembly that supports an electrical junction box on which a hung load is to be disposed. The hanger is longitudinally expandable against the joists at an accelerated rate via a threaded lead screw or rod secured between the displaceable sections of the hanger. Accelerated expansion is achieved by means of an allthread lead screw with a pitch having a greater than standard lead that affords relatively greater displacement between sections per hand revolution of one hanger section relative to the other. Teeth at the opposed distal ends of the hanger are positioned circumferentially about a floating collar facing longitudinally outward. They are arcuately configured to a distal point with a predetermined geometry matched to the expansion rate of the sections and have a laterally inward cant. This configuration enables the teeth to penetrate the joists with an arcuately inward motion operably synchronized to the advance rate of the lead screw to effect a grasping penetration of the joists. Being embedded, the teeth remain secured and cannot incur even partial separation if and when the joists begin to relax. As a result of the firm grasping relation achieved by the teeth, (rather than mere penetration in the manner of the prior art), the loading imposed on the hanger assembly is thereafter sustained by the joists and cannot even miniscule be transferred to the underlying sheet rock comprising the ceiling.

The features and advantages of the invention will be appreciated by those skilled in the art upon reading the detailed description which follows in conjunction with the drawings.

DESCRIPTION OF THE PREFERRED EMBODIMENT

Figure 1:
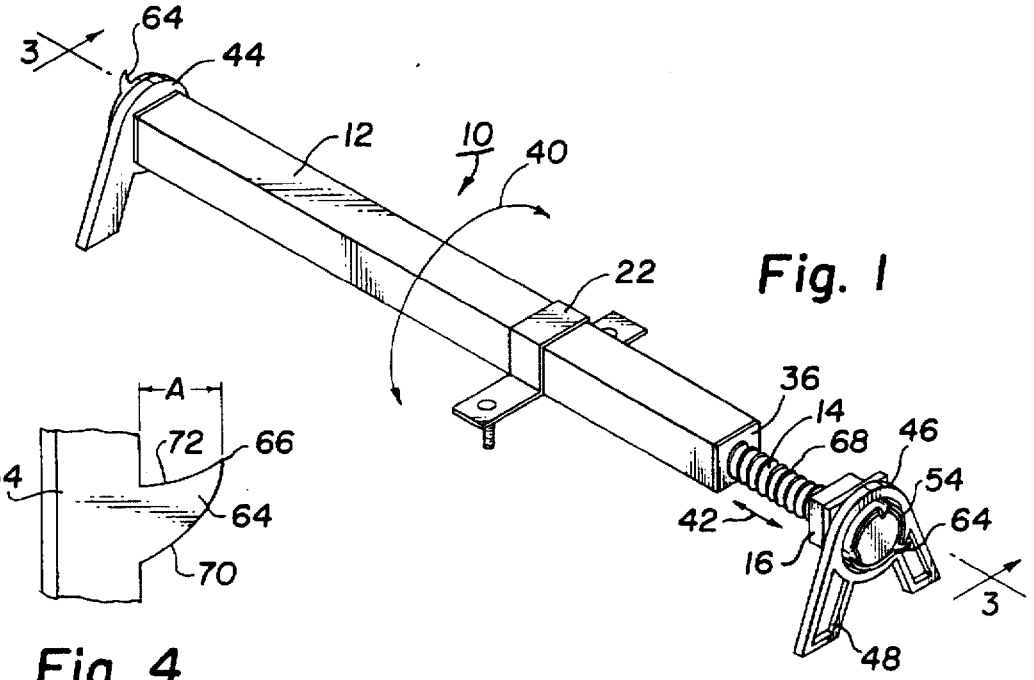
FIG. 1 is an isometric top view of the hanger assembly in accordance with the invention.
Figure 4:
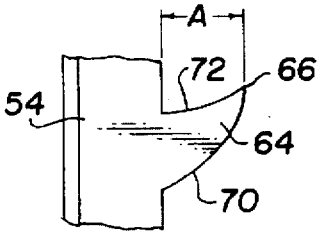
FIG. 4 is a fragmentary enlarged plan view of an individual gripper tooth as utilized on the opposite distal ends of the hanger assembly.

In the description which follows, like parts are marked throughout the specification and drawings with the same reference numerals respectively. The drawing figures are not necessarily to scale and the proportions of certain parts may have been exaggerated for purposes of clarity.

Figure 2:
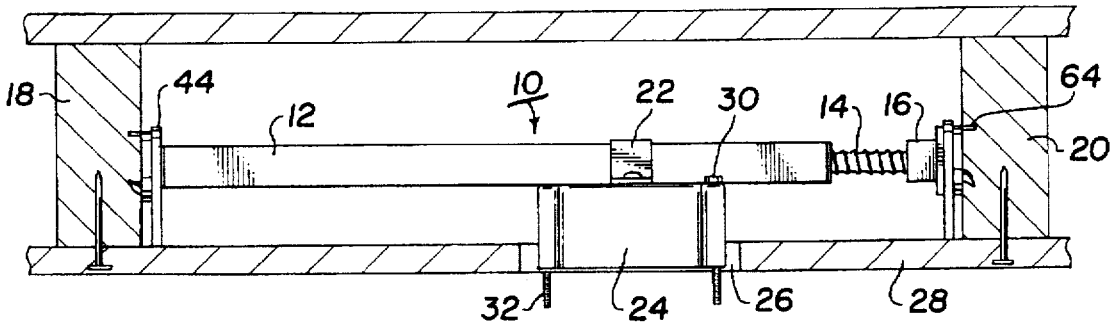
FIG. 2 is a side elevation of the hanger assembly hereof shown in its installed relation.

Referring now to the drawings, the hanger assembly hereof is designated 10 and is comprised of an elongated two-part bar structure including a support bar 12 and a displacement bar 16. Interconnecting the bars is a lead screw bolt or rod 14. As best seen in FIG. 2, the expanded hanger assembly when installed extends transversely between spaced apart joists 18 and 20 and via a saddle 22 secures an electrical junction box 24 over an opening 26 in a ceiling 28. Junction box 24 is preferably of a construction U.L. approved for these purposes and may be of a type disclosed in my prior U.S. Pat. No. 4,909,405. In that construction, load bolt 30 depends through the top surface of the box to a distal end 32 on which a hanging load is to be disposed.

Figure 3:
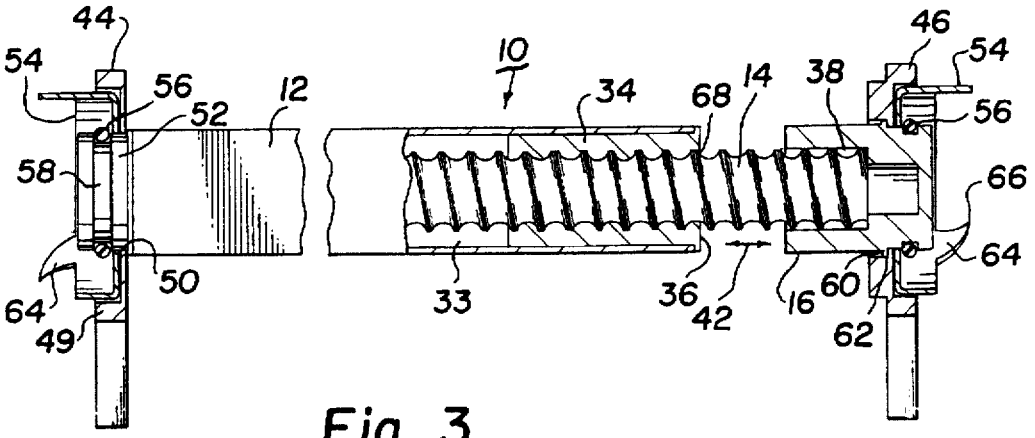
FIG. 3 is an enlarged and partially sectioned side elevation of the hanger assembly as seen substantially along the lines 3—3 of FIG. 1.

Rod 14, as best seen in FIG. 3, extends from a first end located within a tubular portion 33 of bar 12, through a companion sleeve nut 34 and outward past bar end 36 to be secured in coaxial pocket 38 of displaceable bar 16. In this manner, hand rotation of bar 12 in either the clockwise or counter-clockwise directions, as represented by arrows 40 (FIG. 1) will via companion nut 34, cause longitudinal displacement between bars 12 and 16 as represented by arrows 42.

For providing rest support in the course of installation, the opposed ends of the hanger assembly include leg stands 44 and 46 each having depending spread apart legs 48. The body 49 of leg stand 44 is essentially a U-shape configuration in cross-section. Included in body 49 is a central aperture 50 for mounting onto annular shoulder 52 where together with collar 54 it is retained in a free floating relation therewith by means of O-ring 56 in recess 58. Leg stand 46 is similarly mounted but also includes a counter-bore 60 for engaging flange 62 on bar 16. Longitudinally extending integrally from about the periphery of each collar 54 are a plurality of circumferentially spaced teeth 64 of configuration as will be described.

Critical to the hanger construction hereof is that the advance or expansion rate of rod 14 be directly correlated to or at least closely approximate the outward bow rate of the joists incurred during installation and that the rate of penetration to be achieved by collar teeth 64 be synchronized therewith. It is essential in this relation that displacement between bars 12 and 16 be at a rate permitting the contemplated penetration of teeth 64 and not cause teeth 64 to collapse. For these purposes, rod thread 68 comprises an allthread, also known as a modified Acme thread or coil thread of double to triple lead as compared to a standard thread. Unlike a standard thread of ½ inch diameter and having 13 threads to the inch that affords an advance of approximately 0.060 inches per revolution of bar 12, the rod 14 with allthreads 68 of ½ inch 6 threads to the inch will, by comparison produce an advance of 0.180 inches per revolution of bar 12. Correlated thereto is the shape of longitudinal teeth 64 which cant laterally inward about the circumference to a point 66 for penetrating the joist wood with an arcuate motion.

In a preferred embodiment, each tooth has an outside radius 70 of about 5/16 inches with an inside radius 72 of slightly under ¼ inch and a base height "A" of about 0.225 inches. With this configuration, continued forced expansion of the hanger after initial contact of the teeth against the joists causes the teeth to effect an arcuately inward penetration of the joist as collar 54 is arcuately displaced about shoulder 52. With teeth 64 imposing an inward grasp on the joist, any subsequent relaxation of the joists is absorbed by the slack of threads 68 but precludes the possibility of tooth withdrawal from the joists. As a consequence, full support of the suspended load is continuously maintained with only an imperceptible, if any, portion of the load being transferred onto the ceiling below.

To effect installation, the hanger assembly 10 is first inserted through opening 26 above ceiling 28 for support thereat parallel to the ceiling by means of leg stands 44 and 46. Via a hand grip on bar 12, the assembly is first urged leftward as viewed in FIG. 2 until teeth 64 on collar 54 thereat effect an initial engagement with joist 18. Bar 12 is then hand rotated causing displacement of bar 16 until similar engagement is made with the teeth of opposite collar 54 against joist 20. Thereafter, continued rotation of bar 12 imposes a rapid advance of rod 14 causing the teeth 64 on the opposite ends to effect a rotationally inward penetration of the respective joists thereat. Once the hanger assembly is fully secured and positioned, junction box 24 can be attached via saddle 22 in a well known manner and from which a load such as a ceiling fan can ultimately be secured at the distal ends 32 of support bolts 30.

By the above description there is disclosed a novel above-ceiling hanger assembly for support of a hanging load that considerably enhances the installation of such hangers between adjacent joists. By precluding the hanging loading from even partially being transferred onto the underlying ceiling in response to subsequent joist relaxation, risk to the ceiling is avoided. Being that teeth 64 of collars 54 have incurred a rotationally inward penetration of the joists, any subsequent relaxation of the joist will enable the teeth to remain secured and follow within the thread slack accommodation of the rod. As a consequence, a long felt need in the industry has hereby been resolved in eliminating undesirable load transfer onto the ceiling below.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. In a hanger assembly for spanning and positive attachment between a pair of spaced joists, studs and the like elements having opposed surfaces and comprising a pair of longitudinally displaceable support bars, a threaded expansion rod interconnecting said support bars, a companion nut secured in one of said support bars in threaded engagement with said rod and effective when rotated to displace said expansion rod while relatively displacing said bars, and longitudinally extending teeth supported at the distal end of each of said support bars for penetrating the joist surfaces thereat as said bars are displaced relatively apart against the joists; the improvement comprising:

first means operative for effecting a grasping penetration between said teeth and joists in the course of said bars being outwardly displaced.

2. The improvement in accordance with claim 1 in which said first means is operative to arcuately displace said teeth inward of the joist in the course of effecting said grasping penetration.

3. The improvement in accordance with claim 2 including second means operative to effect displacement between said bars at a rate correlated to the rate of grasping penetration effected by said first means.

4. The improvement in accordance with claim 3 in which said companion nut and rod cooperate to comprise said second means and said rod includes an allthread having a pitch providing a lead operative for effecting a relatively rapid displacement rate per revolution of said one support bar and companion nut compared to a like sized rod of standard pitch.

5. The improvement in accordance with claim 4 in which the rate of displacement effected between said bars by said second means and the rate of grasping penetration effected by said first means are correlated to each other to ensure arcuate displacement of said teeth inward of the joists thereat.

6. The improvement in accordance with claim 5 in which said allthread pitch of said second means effects said displacement at a rate substantially corresponding to the natural bow rate incurred by the joists in the course of hanger installation.

7. The improvement in accordance with claim 6 in which said grasping penetration of said teeth with said joists by said first means is effective to prevent separation of said teeth from said joists in response to subsequent relaxation of said joists.

8. The improvement in accordance with claim 2 in which the distal end of each of said bars includes an annular collar supported for floating rotation thereon, and said teeth are integral of said collar, are circumferentially spaced in the peripheral plane thereof and extend longitudinally outward while laterally canted circumferentially inward to a pointed edge.

9. The improvement in accordance with claim 8 in which each of said teeth has an inside radius and an outside radius and said inside radius is dimensionally less than said outside radius.

* * * * *